United States Patent [19]

Farah

[11] Patent Number: 5,013,378

[45] Date of Patent: May 7, 1991

[54] PLEATED TROUSER CREASE-FORMING METHOD AND MACHINE IMPROVEMENTS THEREFOR

[75] Inventor: William F. Farah, El Paso, Tex.

[73] Assignee: Farah Incorporated, El Paso, Tex.

[21] Appl. No.: 443,890

[22] Filed: Nov. 30, 1989

[51] Int. Cl.[5] ..... D06J 1/12; A41D 1/10; B05C 13/02

[52] U.S. Cl. ..... 156/226; 156/285; 156/578; 38/144; 68/200; 223/28; 427/294

[58] Field of Search ..... 2/231; 38/144; 68/200; 156/226, 285, 578; 223/28; 427/276, 294

[56] References Cited

U.S. PATENT DOCUMENTS

| | | | |
|---|---|---|---|
| 4,182,264 | 1/1980 | Gibson et al. | 401/38 X |
| 4,191,793 | 3/1980 | Gibson et al. | 223/28 X |
| 4,756,170 | 7/1988 | Gibson et al. | 68/200 |
| 4,778,299 | 10/1988 | Coulter | 68/200 X |

*Primary Examiner*—Michael W. Ball
*Assistant Examiner*—Mark A. Osele

[57] ABSTRACT

A method for producing a permanently pleated garment is disclosed, whereby pleat formation is achieved during subassembly before the garment is finished by positioning a subassembly with a pre-pressed pleat on a vacuum device having a conforming pleat groove, exerting a vacuum on the subassembly and on a pleat formed within the subassembly, maintaining a vacuum on the garment subassembly and the pleat, dispensing a sufficient amount of polymeric dispersion along the pleat while maintaining the vacuum, and folding and removing the subassembly from the vacuum device, followed by curing of the polymeric dispersion and incorporation of the subassembly in a finished garment.

10 Claims, 4 Drawing Sheets

PLEATED TROUSER CREASE-FORMING METHOD AND MACHINE IMPROVEMENTS THEREFOR

This invention relates to crease-forming methods for pants and like articles; more specifically, this invention relates to a method for crease forming of front panels for pants of the pleatless front and pleated front type pants. Still further, this invention relates to a method for achieving such pleat formation for component parts for pants before the assembly of the pants, thus better facilitating pleat formation and pleat creasing of a permanent type.

BACKGROUND FOR THE INVENTION

With the advent of permanent press garments, a great demand has been for garments which would have permanently formed creases or pleats such that repeated washings and cleaning of the garments would still allow such crease or pleat retention. A number of methods exist for achieving such pleat formation, but these depend on a number of steps in a different place in a process sequence used in the art for producing these articles of clothing. Thus, processes have been used requiring a full garment production first and then imparting to the finished garment permanent pleats or using a method for forming pleats in an almost completely finished garment. Among these methods is a method requiring the use of machinery that is inserted into a pants leg for forming a permanent pleat by depositing a material on the interior of such garment, which ostensibly provides for such permanent crease. Needless to say, such pleat forming methods are slow and cumbersome.

In considering the prior art methods and the various applications for pleat formation, Applicant is aware of the following patents:

U.S. Pat. No. 4,778,299 granted Oct. 18, 1988 to Coulter;

U.S. Pat. No. 4,756,170 granted July 12, 1988 to Gibson et al.;

U.S. Pat. No. 4,607,589 granted Aug. 26, 1986 to Gibson;

U.S. Pat. No. 4,191,793 granted Mar. 4, 1980 to Gibson et al.;

U.S. Pat. No. 4,182,264 granted Jan. 8, 1980 to Gibson et al.;

U.S. Pat. No. 4,095,538 granted June 20, 1978 to Rockerath et al.;

U.S. Pat. No. 4,009,672 granted Mar. 1, 1977 to Rockerath et al.;

U.S. Pat. No. 3,931,786 granted Jan. 13, 1976 to Teed;

U.S. Pat. No. 3,906,877 granted Sept. 23, 1975 to Rockerath et al.;

U.S. Pat. No. 3,871,312 granted Mar. 18, 1975 to Rockerath et al.;

U.S. Pat. No. 3,863,579 granted Feb. 4, 1975 to Rockerath et al.;

U.S. Pat. No. 3,435,463 granted Apr. 1, 1969 to A. Jay;

U.S. Pat. No. 3,372,403 granted Mar. 12, 1968 to N. F. Getchell;

U.S. Pat. No. 3,166,765 granted Jan. 26, 1965 to N. F. Getchell;

U.S. Pat. No. 3,052,211 granted Sept. 4, 1962 to Shirley et al.;

U.S. Pat. No. 2,893,315 granted July 7, 1959 to Reynolds et al.;

U.S. Pat. No. 2,893,314 granted July 7, 1959 to G. T. Gore;

U.S. Pat. No. 2,524,989 granted Oct. 10, 1950 to W. L. Payne;

U.S. Pat. No. 2,440,573 granted Apr. 27, 1948 to C. Brode;

U.S. Pat. No. 2,279,663 granted Apr. 14, 1942 to R. A. Dillon;

U.S. Pat. No. 2,129,403 granted Sept. 6, 1983 to L. G. Bowman;

U.S. Pat. No. 2,110,644 granted Mar. 8, 1938 to L. G. Bowman;

U.S. Pat. No. 1,816,652 granted July 28, 1931 to K. Nakashian;

U.S. Pat. No. 1,500,570 granted July 8, 1924 to B. J. Bodnar;

U.S. Pat. No. 1,413,885 granted Apr. 25, 1922 to C. A. Anderson;

U.S. Pat. No. 979,780 granted Dec. 27, 1910 to D. Marinsky;

U.S. Pat. No. 874,818 granted Dec. 24, 1907 to A. Abrams;

U.S. Pat. No. 751,741 granted Feb. 9, 1904 to D. Lyons;

U.K. Patent 2,181,368 granted Apr. 23, 1987 to D. W. Spence;

European Patent 0 138 327 granted Apr. 24, 1985 to Gibson.

Among these patents, it is noted that a number of patents disclose application tools for dispersing a curable polymer in the crease, either before the full garment assembly or thereafter, such that a permanently formed crease or pleat is evident.

In all of the prior art, the industrial side of the production has not been addressed in a manner which would allow the formation of the crease or pleat to be carried out before the sewing of the garment components and before the final assembly of the garment.

BRIEF DESCRIPTION OF THE INVENTION

It has now been found that an improved method for manufacturing pants with improved crease forming characteristics has been discovered, which method is based on the advantages realized when employing subassembly workup of pants components for imparting the desired pleat characteristics. This method depends on the use of a novel combination of steps whereby a polymer dispersion is now deposited on a subassembly of the pants allowing the polymer dispersion to cure and thereafter incorporating a finished subassembly into a finished product. Moreover, the method for forming the improved pleats or creases, either for plain front, i.e., pleatless front, or for pleated front trousers, can now be achieved in a far superior manner from the methods formerly suggested for employment for that purpose or for using different means for achieving a permanent or semipermanent pleat in such type of pants.

Accordingly, the novel method depends upon a proper placement on a vacuum table of a previously pressed pants subassembly having a pleat therein, forming a polymer bead on the inside of the subassembly pleat, employment of a vacuum in combination with the previously pressed pleat to finish the impregnation, removing the subassembly from the vacuum table by folding it over along the pleat, and curing in a highly desirable manner so as to provide by this method a semi-assembly of the pants fabric that will have a high pleat retention and at the same time crease resistance during the use of the garment.

As a result of the above-described method, advantages have accrued to the manufacturing cycles, such as improved pre-assembly steps, highly precise, but operator-repetitive, process steps, etc. Still further, visible and readily apparent results are evident during the practice of the method, such that a high order of quality control assurance can be obtained. This is in distinction from polymer deposition in the interior of the garment or exterior of the fabric which then requires the garment thereafter to be inverted.

Still further, by the practice of this method, very low wastage is encountered as a result of the excellent quality control aspects. Moreover, high polymer dispersion utilization is obtained because of great assurance of positive deposition and impregnation associated with the highly accurate placement of the polymer dispersion on the garment. As a consequence of these advantages, excellent results have been obtained in the appearance of such garments.

DETAILED DESCRIPTION OF THE DRAWINGS AND EMBODIMENTS OF THE INVENTION, INCLUDING BEST MODE FOR CARRYING OUT THE INVENTION

Turning now to the drawings wherein the present invention has been illustrated, and wherein.

Figure 7A:
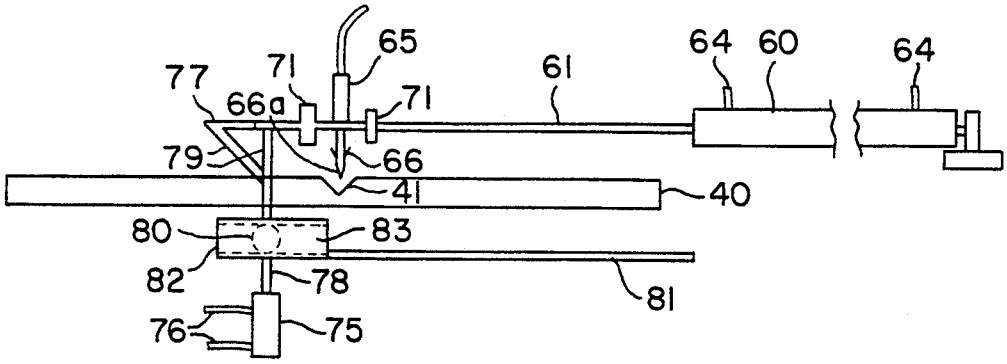
FIG. 7 is a front view of the device shown in FIG. 6.
Figure 6:
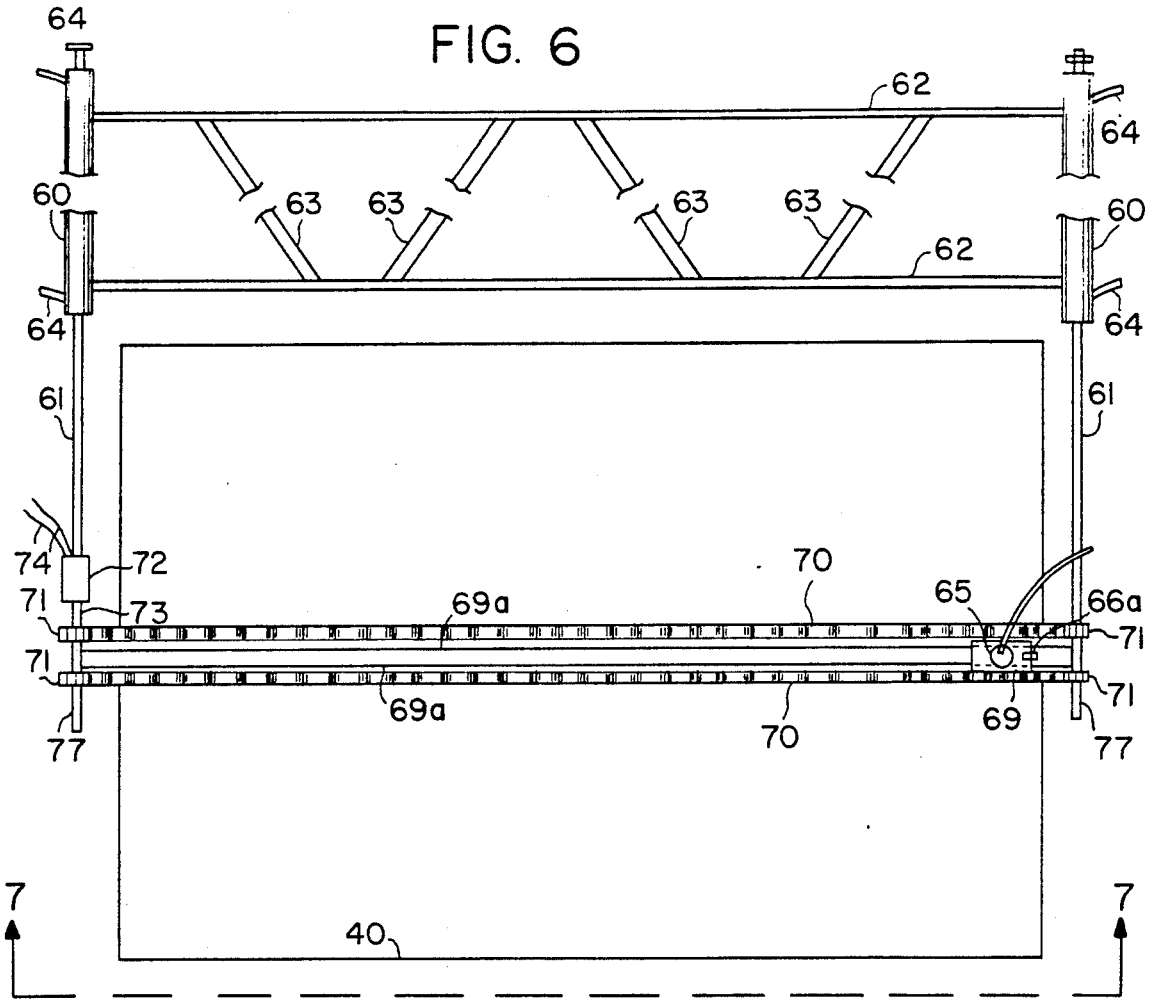
FIG. 6 is an embodiment shown in top view of a machine for depositing on a subassembly of a garment a polymer dispersion in a pre-pressed pleat for the subassembly.
Figure 8:
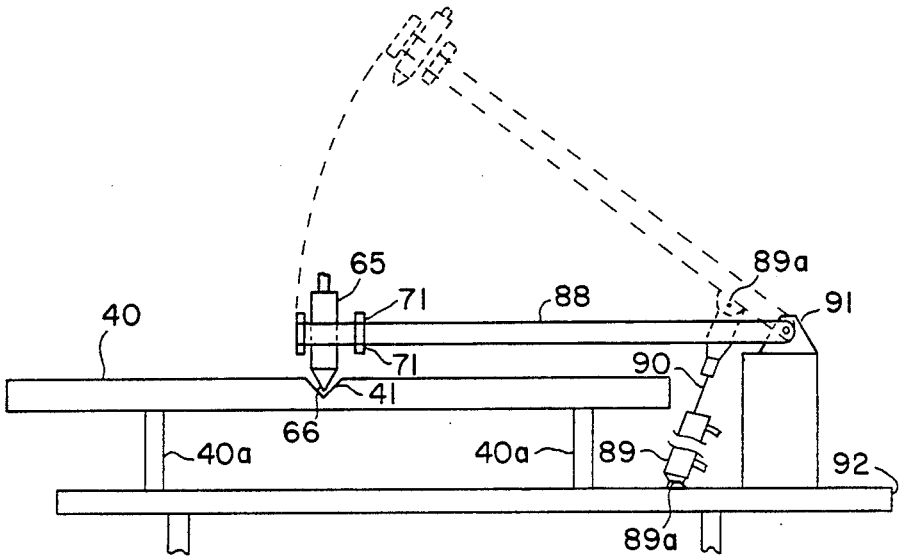
Figure 9:
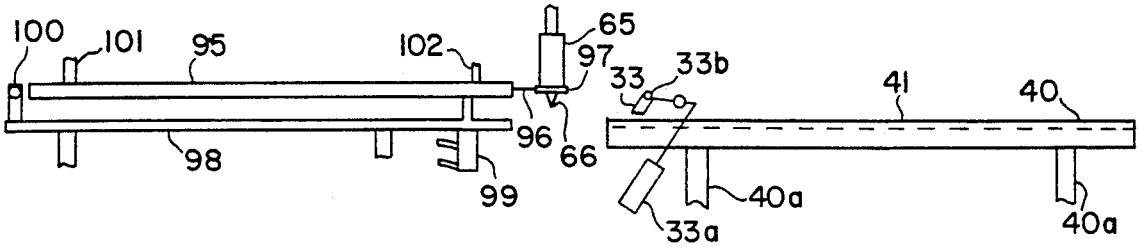

FIG. 7*a* is a schematic righthand side view of the device shown in FIG. 6;

FIG. 8 is a side view of a variation of the device shown in FIG. 6;

FIG. 9 is a further embodiment of device for depositing a polymer dispersion on a subassembly of a pant leg.

Figure 1:
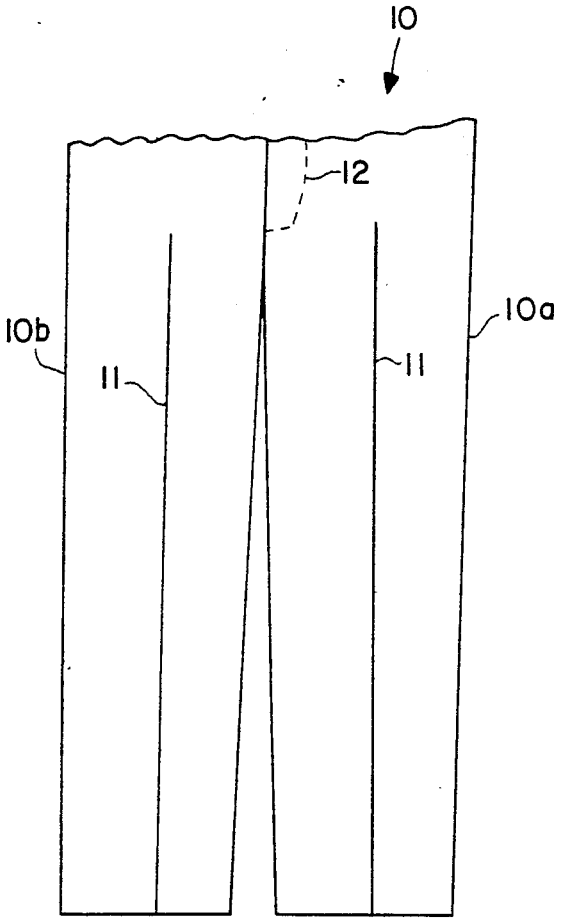
FIG. 1 shows a front view of a plain or pleatless front pant.

Turning now to the drawings and discussing these in greater detail, as shown in FIG. 1, it illustrates a plain front trousers 10 in a partial view, showing a typical right leg 10*a* and left leg 10*b*. Each of the front panels have a pleat 11 which does not extend much beyond the bottom of fly 12.

Figure 2:
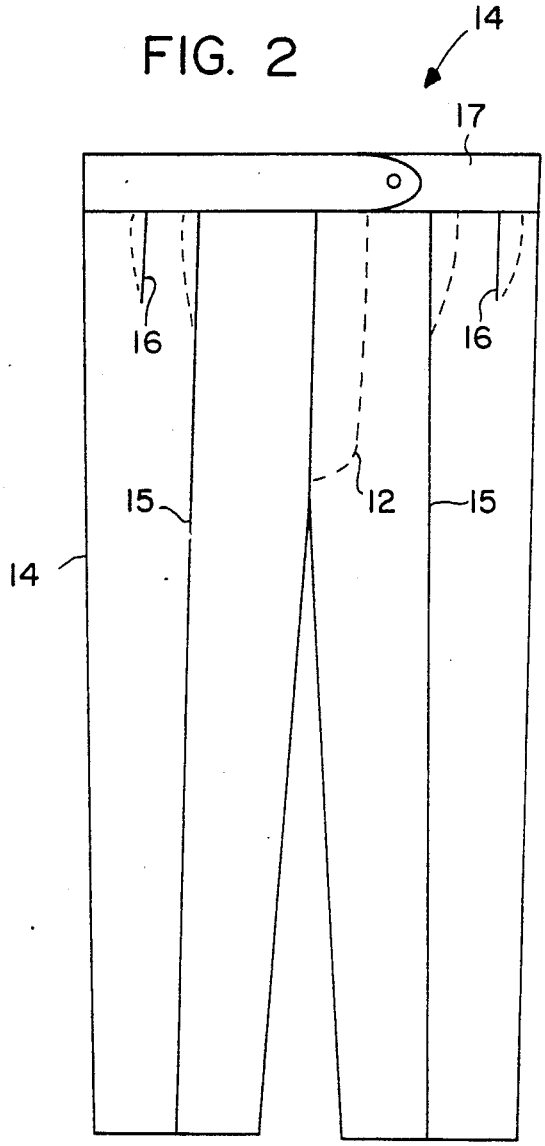
FIG. 2 shows a front view of a pleated front pant.

In FIG. 2, a front view of a pleated front pants 14 has been shown with the front pleats identified as 15 and the tuck pleats shown as 16. In addition, waistband 17 has also been shown for these pants.

Figure 3:
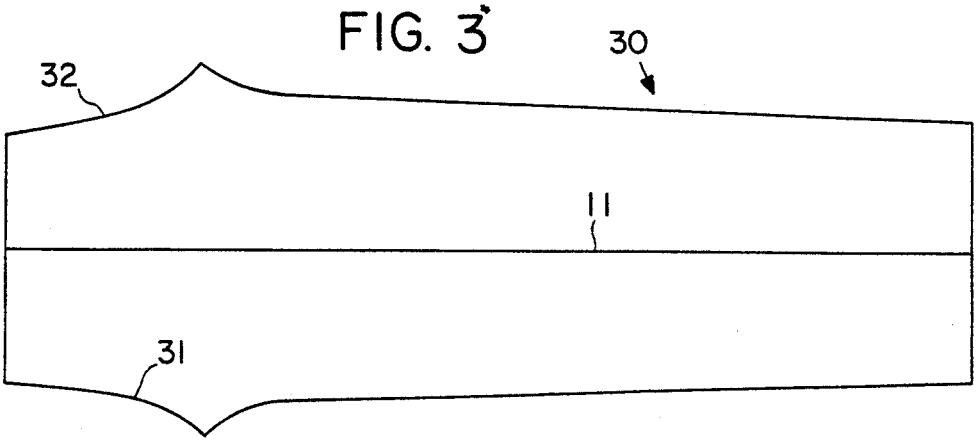
FIG. 3 is a subassembly of a plan view of a right pant front panel.
Figure 4:
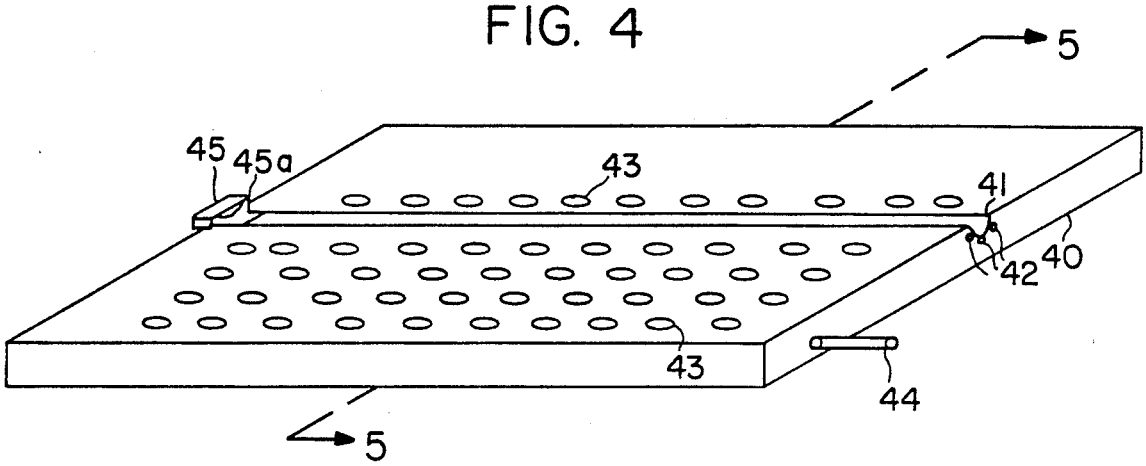
FIG. 4 is a perspective view of a vacuum table with a pleat groove therein.

FIG. 3 shows a plan view of a right pant front panel subassembly identified as 30 with the fly side cut out, shown as 32 and the pocket side cut out as 31. Turning now to FIG. 4, it illustrates a vacuum table 40 used in the practice of the method disclosed herein. Vacuum table 40 has a pleat groove 41 including pleat groove vacuum passages 42. Additionally, vacuum table has vacuum table holes 43 through which the vacuum acts upon the garment component when it is placed on the vacuum table 40. A vacuum exhaust hole 44 has been identified therein. In addition, a vacuum header box 45 for pleat groove 41 has been shown in FIG. 4. This header box 45 allows vacuum to be applied independently from the vacuum table and confine it to the pleat groove 41 for easier and more positive manipulation of the subassembly placed on the vacuum table 40.

Figure 5:
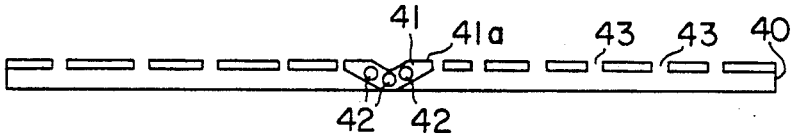
FIG. 5 is a cross-section of the vacuum table shown in FIG. 4 along cross-section lines 5—5 thereof.

In FIG. 5, which is a cross section of the vacuum table 40 shown in FIG. 4 along lines 5—5 thereof, the vacuum table 40 has been shown with the vacuum holes appropriately illustrated. The pleat groove 41 shown in FIG. 5 has been illustrated as a separate assembly, although it may also be incorporated intercommunicatingly with the rest of the vacuum table 40. For the sake of easy operation, however, when a garment subassembly is placed on the vacuum table 40 with the outside of the garment face down and the previously pre-pressed pleat in this subassembly placed in the pleat groove 41, the subassembly may be more easily manipulated without the vacuum being applied on the entire table. For this reason, the header box has a separate outlet 45*a* through which vacuum may be exerted on the pleat groove 41 and its pleat groove vacuum passages 42 shown in FIG. 4 (these are one end closed in operation), as well as in FIG. 5.

As mentioned before, the pre-pressed pleat 11 or 15 is placed on the vacuum table in the pleat groove 41 and the garment may be held down by vacuum and by two clamps 33, one on each side of the groove. A clamp may be activated when the nozzle 66 enters the groove, and will cause the garment to move, e.g., ¼ inch to ⅜ inch, in a direction opposite to the direction in which the nozzle moves.

Appropriate shaping of the pleat groove 41 also is based on the type of garment, the material, the necessity for an appropriate depth of pleat groove 41, the appropriate vacuum being applied on the pleat 11 to pleat groove vacuum passages 42, and the like.

Turning now to FIG. 6 in the drawings, it illustrates the aforementioned vacuum table 40 and the pleat groove 41 and shows these in a top view in combination with a device used for depositing a polymeric dispersion from a container.

Thus a first pair of pneumatic cylinders 60 has been shown, one on each side of the vacuum table 40. These cylinders have the pneumatic cylinder rods of an appropriate length to reach to the pleat groove 41. In order to improve the bracing of the first pair of pneumatic cylinders 60, pneumatic cylinder frame beams 62 joined by pneumatic cylinder frame cross beams 63 provides appropriate rigidity to the assembly. The first pair of pneumatic cylinders 60 have appropriate pair inlets 64 and when the rods 61 are retracted vacuum table 40 and pleat groove 41 are uncovered so that a subassembly may be placed in portion thereon. To allow removal and placement of a new subassembly on vacuum table 70, the extension and retraction stroke of the first pair of pneumatic cylinders 60 is appropriately manipulated by control devices well known in the art, but not shown herein.

The pneumatic cylinder rods 61 at the end thereof carry rod heads 77, as shown in FIGS. 6 and 7*a*. These rod heads 77 are extensions of rods 61 and carry thereon sprocket gears 71 for chains 70 for driving a polymer dispersion container car 69 holding polymer dispersion container 65. Polymer dispersion container has a polymer dispensing nozzle 66. A nozzle follower 66*a*, shown also in FIG. 7, smooths the polymer in the prepressed pleat 11 or 15 and may be appropriately adjusted. A supply hose 67 for supplying the necessary polymer amount to keep the polymer dispersion container 65 filled has been shown in FIG. 7. A supplemental pneumatic assist 68 for allowing polymer dispersion through dispensing nozzles 66 may act both in a pneumatic, i.e., pressurized, state, as well as in a slight vacuum state to allow the retraction of polymer for a brief instant upon the completion of the work stroke, i.e., dispensing from polymer dispensing nozzle 66. Polymer dispersion container car 69 is thus attached to the chains 70 and rides on a pair of rods 69*a* shown in FIGS. 6 and 7, and may be driven either in a single work direction mode by DC motor 72 driving the sprocket gears 71. A non-dispersing nozzle 66 is also used to smooth out with the nozzle 66 the previously deposited polymer, or the previously mentioned nozzle follower 66*a* may be used. The DC current supply leads are shown for the reversing motor as 74.

As illustrated in FIG. 6, drive shaft 73 is directly interconnected to the sprocket gears 71, but it also may be appropriately geared to drive sprocket gears 71 depending on the desired velocity with which the polymer dispersion container car 69 is being driven.

Figure 7:
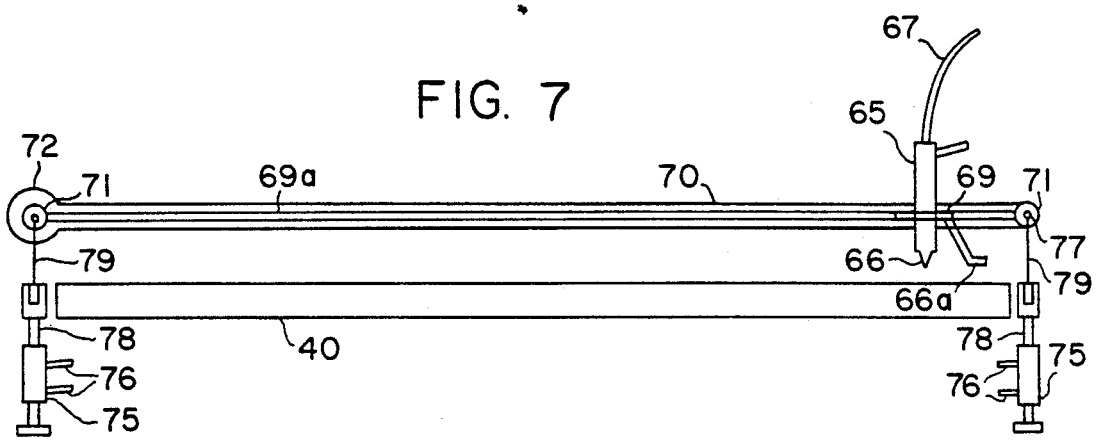

In order to assure positive placement of the polymer dispensing nozzles 66 in the pleat groove 41, as shown in FIG. 7, the pneumatic cylinder rods 61 at the end thereof have rod heads 77 to which are mounted braces 79 for follower wheels 80. A pair of follower wheels are mounted on each side of brace 79 and ride on rail 81 until follower wheels 80 are engaged by capture rail 82 for the follower wheels 80. A capture slot 83 in capture rail 82 assures a positive engagement and, if necessary, a dead stop (not shown) so that when the second pair of pneumatic cylinders 75 for depth positioning of polymer dispensing nozzle 66 are retracted or extended, the work stroke and the idle stroke may appropriately be achieved.

Thus rods 78 for the second pair of pneumatic cylinders 75 carry thereon the thus adjustable capture rail 82. Consequently, a very precise positioning of the polymer dispensing nozzle 66 may be achieved in a vernier like manner by slightly adjusting the position of the capture rail 82 upon the downstroke of cylinder rod 78. Appropriate pneumatic supply lines for the second pair of cylinders have been shown as 76. The work stroke of the device shown in FIG. 6 is from right to left. It may also be from left to right, in which event the nozzle follower 66*a* is on the left hand side of the nozzle 66.

Thus along the same lines to improve the operator efficiency, the device shown in FIG. 8 approximates in all essential characteristics the device shown in FIG. 6 with the difference that lift frame 88 has been provided. Before polymer dispersion container 65 is operated by a pair of pneumatic lift cylinders 89, one of which has only been shown in the side view depiction of this embodiment, nozzle 66 is accurately engaged. Each of the pneumatic lift cylinders 89 is appropriately toggled at toggle points 89*a* and thus facilitate the lifting of the lift frame 88 articulating pivoting lift frame 88 around pivot point 91. Support table 92 thus supports vacuum table 40 (via legs 40*a*), lift cylinders 89, and pivot point 91 for frame 88. The advantage of this embodiment is that the polymer dispersion container 65 can be readily removed for a proper placement of a garment in the pleat groove 41, at the same time retaining the left direction for the desired work stroke. Appropriate dead stops (not shown) eliminate the backlash of the lift frame 88 and also allow the proper placement of the polymer dispensing nozzle 66 in groove 41. Again, the same type of chain and sprocket arrangement as shown in FIG. 6 is employed for driving the polymer dispersion container 65; and again, a carriage 69 and carriage rods 69*a* may be employed for precise guidance of nozzle 66 and nozzle follower 66*a*.

Turning now to FIG. 9, it illustrates still another embodiment where the device having only a work stroke from left to right over the vacuum table 40 is shown. Accordingly, the single work stroke pneumatic cylinder 95 is extended from left to right for a work stroke. At the end of this single work stroke pneumatic cylinder 95, its rod 96 has a rod head 97 carrying thereon the polymer dispersion container 65 is adjusted for precise positioning of the polymer disposing nozzle 66 in groove 41. This is achieved by employment of a lift cylinder 99 which, during the work stroke, allows downward placement of polymer dispensing nozzle 66 in pleat groove 41. Upon the completion of the stroke, lift cylinder 99 either urges upwardly, by articulating through pivot point 100, the single work stroke pneumatic cylinder 95 with the polymer dispersion container 65 and thus removing the nozzle 66 from the vacuum table 40 and then allowing the retraction of the rod 96. A nozzle follower 66*a* for smoothing out the polymer is also provided (not shown in FIG. 9). Pivot point 100, as well as lift cylinder 99 are mounted on table 98 for single work stroke pneumatic cylinder 95. As shown in FIG. 9, the pneumatic fluid work stroke inlet has been identified as 101, and the pneumatic fluid retract stroke inlet identified as 102. As mentioned previously and applicable to the devices shown in FIGS. 6 to 8, a pair of clamps 33, i.e., to stretch slightly the garment, with activating cylinder 33*a* may be used to retract the fabric against the work stroke of the nozzle 66 and nozzle follower 66*a*. A spring loaded pivot point 33*b* and an arcuate surface for clamps 33 in conjunction with work cylinder 33*a* provides the adjustable retraction—stretch for the garment subassembly. These clamp 33 devices may be installed on the machine, such as shown n FIG. 6 on the table 40, or on the cylinder rod heads 77 for pneumatic cylinder rods 61. A clamp 33 is placed on each side of the vacuum groove 41.

From the above described variations which allow positive and precise placement of the garment on the vacuum table while at the same time very precise positioning of the pleat 11 in the groove 41 (as assisted by the groove vacuum passages 42), it is evident that a very well controlled amount of polymer dispersion may be achieved through the polymer dispensing nozzles 66 and polymer nozzle follower 66*a*. Thus the vacuum passages 42 provide a positive adherence and impregnation to the desired degree of the polymer dispersion in the garment subassembly. At the same time, the operator may readily control the quality and the appearance of the polymer bead which is being deposited in the pleat 11. The quality control step is thereby highly visible and assured. An appropriately colored polymer dispersion is used for colored fabrics of different types so as not to show a contrast in the fabric. After the polymer has been deposited, the subassembly is folded over and removed from the vacuum table 40.

In addition, the stroke control during polymer dispensing may be finely adjusted by the up and down movement of the polymer dispersion container 65 as shown by the various means disclosed herein and by the carriage, e.g., 69 in combination with the carriage rods 69*a*. Also, the configuration of the pleat groove 41 may be very precisely designed. Hence, not only at the beginning of the setup but also during the actual operation, very precise means are provided for polymer deposition. Inasmuch as the vacuum table 40 assists in holding and confining the garment subassembly on the table as well as in the groove, the clamp-stretching device 33 for the garment subassembly prevents cloth stretch which may cause uneven polymer dispersion. It is seen that the work cycles in the manner can produce a very high rate of garment subassemblies of excellent quality with each garment subassembly precisely quality controlled.

As the pleat has already been pressed into the garment subassembly and the location of the pleat is now very accurately established on the vacuum table, it is clear that upon removal, i.e., the folding of the subassembly along the pleat, this pleat has been adequately formed so that it may be merely stacked in an appropriate stack and allowed to cure, e.g., overnight, before final assembly is then started on the garment.

As it is evident from the above-described method, appropriate vacuum tables with appropriate grooves may be furnished both for the plain front trousers as well as for the pleated trousers. By mounting appropriate dispensing means with follow-up smoothing of the polymer, such as the polymer dispersion heads described above, and activating dispensing during the necessary length, depth and retraction type of polymer deposition cycle at the necessary location, great variations in the production cycle may be tolerated with very slight adjustments in the setup.

This freedom from working on a completed garment is in great distinction from the prior art device which require extensive setup time to achieve a satisfactory rate of garment production and quality control. Moreover, for the disclosed method the placement of the polymer bead on the inside of the garment subassembly with the face down allows a garment-to-garment subassembly quality control which is not possible with the prior art devices. Because of the various advantages, the disclosed method allows one operator to operate two machines while maintaining outstanding quality control.

Still further, inasmuch as a number of polymeric compositions have been tried and used, it is clear that the present method allows various polymer combinations to be used in the present device. The supply may be from a central polymer dispersion container to each of the polymer dispersion containers 65 or each of the polymer dispersion containers 65 may carry sufficient amounts of polymer dispersion in it to be operated during the entire work cycle of a work shift.

As an illustration of a suitable polymer, it has been found that polymers such as N.Sil TM Silicone Rubber Adhesive (RTV Silicone Rubber Adhesive Sealant), available from General Electric Company, Silicone Products Division, Waterford, N.Y., 12188, and like sources such as 3M of Minneapolis, Minn., provides for the properly polymer treated and cured pleats.

In any event, it has been also found that the production cycles with the present devices far exceed those achievable in the prior art, and thus the method as disclosed herein is believed to be an advance in the art, as well as a necessary element for a competitive production of the garments.

While the discussion has been about men's pants and the like, other garment subassembles may be appropriately produced according to the present method.

What is claimed is:

1. In a method for producing a permanently pleated garment whereby pleat formation is achieved during subassembly thereof but before finishing said garment, the improvement comprising: positioning a subassembly with a pre-pressed pleat therein on a vacuum device having a conforming pleat groove thereon, exerting a vacuum on said subassembly and on a pleat formed within said subassembly, maintaining a vacuum on said garment subassembly and said pleat dispensing along said pleat a sufficient amount of a polymeric dispersion, maintaining a vacuum on said pleat while dispensing said polymeric dispersion, and folding and removing said subassembly from said vacuum device for curing of said polymeric dispersion and subsequent incorporation in a finished garment.

2. The method as defined in claim 1, wherein the dispersion of the polymeric material in said pleat is aided by vacuum in said pleat groove and a nozzle or nozzle follower means.

3. The method as defined in claim 1, wherein a separately manipulatable vacuum is exerted within said pleat groove for said subassembly.

4. The method as defined in claim 1, wherein a precise positioning of polymer dispensing and polymer smoothing are maintained in combination with a work stroke during the polymer dispensing.

5. The method as defined in claim 1, wherein pleat retraction and positioning means are employed in combination with vacuum during a work cycle.

6. The method as defined in claim 1, wherein each garment subassembly positioning of said subassembly on said vacuum device includes means for biasing said subassembly in a direction opposite to a work stroke.

7. The method as defined in claim 1, wherein a polymer bead as deposited on said subassembly is dispersed further by a nozzle follower for smooth dispersal of said polymer bead.

8. In a machine for forming garment subassemblies with improved pleat characteristics for final incorporation in a garment, the combination comprising a first means for exerting a vacuum on a subassembly, second means for exerting a vacuum on an isolated part of said subassembly, said first means for exerting vacuum on said subassembly comprise means for vacuum differentially manipulatable from said first means for exerting vacuum on said subassembly, means for dispensing a polymer dispersion along a predetermined path, means for precise positioning said polymer dispersion and means for further dispensing of said polymer by vacuum assisted means.

9. The device as defined in claim 8, wherein the means for polymer dispersion include a means for precise positioning of said polymer dispersion means and a dispersion nozzle follower means for smoothing of said polymer dispersion.

10. The device as defined in claim 8, wherein the means for polymer dispersion include a means for an idle stroke without readjustment of said mean for dispersing said polymer on said subassembly.

* * * * *